United States Patent [19]

Härtel et al.

[11] 4,433,661

[45] Feb. 28, 1984

[54] DEVICE FOR THE SPEED-DEPENDENT CLOSURE LIMITATION OF A CARBURETTOR MAIN THROTTLE

[75] Inventors: Günter Härtel, Neuss; Armin Schürfeld, Meerbusch; Wolfgang Jordan, Grevenbroich, all of Fed. Rep. of Germany

[73] Assignee: Bosch & Pierburg System oHG, Fed. Rep. of Germany

[21] Appl. No.: 275,430

[22] Filed: Jun. 19, 1981

[30] Foreign Application Priority Data

Jun. 20, 1980 [DE] Fed. Rep. of Germany ..... 3022999

[51] Int. Cl.[3] ..... F02M 7/04

[52] U.S. Cl. ..... 123/339; 123/340; 123/341

[58] Field of Search ..... 123/339, 340, 341

[56] References Cited

U.S. PATENT DOCUMENTS

| | | | |
|---|---|---|---|
| 3,554,173 | 1/1971 | Masaki et al. | 123/339 |
| 3,741,177 | 6/1973 | Schultz | 123/339 |
| 3,788,288 | 1/1974 | Harrison et al. | 123/339 |
| 4,168,681 | 9/1979 | Kawai et al. | 123/339 |
| 4,289,107 | 9/1981 | Peters | 123/339 |
| 4,345,556 | 8/1982 | Crouillere | 123/339 |

FOREIGN PATENT DOCUMENTS

| | | | |
|---|---|---|---|
| 54-113731 | 9/1979 | Japan | 123/339 |

*Primary Examiner*—Parshotam S. Lall

*Attorney, Agent, or Firm*—Toren, McGeady and Stanger

[57] ABSTRACT

A device for the speed-dependent closing limitation of a selectively adjustable carburettor main throttle, which is prestressed in the closing direction, includes a variably positionable throttle stop for effecting a substantially complete closure of the main throttle above a rotational speed switching threshold higher than the idling speed. Such a closure interrupts the supply of fuel and air. The throttle stop causes an idling minimum opening position of the main throttle below the switching threshold. The device includes an electromagnetic valve which operates when the speed drops below the switching threshold. The electromagnetic valve has a valve outlet and a pair of valve inlets. A diaphragm box divided into separate chambers is mechanically connected with the throttle stop and one chamber is continuously vented. When the speed is above the switching threshold and also when the ignition is turned off the valve outlet is in flow communication with one of the valve inlets. The electromagnetic valve is connected through its outlet with one chamber in the diaphragm box. One of the valve inlets of the electromagnetic valve is connected with the engine intake pipe via a check valve and the other valve inlet is connected with the ambient atmosphere or another pressure source.

22 Claims, 8 Drawing Figures

DEVICE FOR THE SPEED-DEPENDENT CLOSURE LIMITATION OF A CARBURETTOR MAIN THROTTLE

BACKGROUND OF THE INVENTION

This invention relates to a device for the rotational speed-dependent closure limitation of an arbitrarily adjustable carburettor main valve, biased in the closing direction, having a positionally variable throttle stop which, above a rotational speed switching threshold situated above the idling rotational speed, permits a substantially complete closing of the main throttle and thereby interruption to the fuel and air feed and which, below the rotational speed switching threshold, causes an idling minimum opening position of the main throttle, and comprising an electromagnetic switching element governed when the speed falls below the rotational speed switching threshold.

In one known device of this type—carburettor hand book Illgen, fourth edition, 1957, pp 55/56—the electromagnetic switching element is a control magnet, which is energized below the rotational speed switching threshold in order to press the main throttle of a fixed air funnel carburettor into the idling minimum open position via a pivotally journalled crank lever pulled up by the control magnet. Above the rotational speed switching threshold, the control magnet is de-energized, so that the main throttle may be completely closed by means of a closure spring in the thrust phases, that is when the accelerator pedal is released. As a result, the outlet opening of the idling system, which is swept over by the main throttle, is also fully closed. When the rotational speed decreases in the thrust phases and finally falls below the rotational speed switching threshold, the control magnet assures a slight opening of the main throttle, causing the idling system to be brought into operation and the engine not to stop unintentionally. At each renewed rise above the rotational speed switching threshold, the main throttle can once again fully close, which corresponds to a certain control of the idling rotational speed. This known device serves for saving fuel (in the thrust phases) and for regulating the idling rotational speed.

In the known device, in the thrust phases, simultaneously with the fuel feed the air feed is also interrupted, by the main throttle being fully closed. The reason for this interruption of the air feed also is not stated in this prior publication. Within the scope of the present invention it has, however, been established that this reduction, taking place in thrust operation, of the air feed also except for small leakages renders possible a jerk-free decelerating passage through the speed switching threshold. When the main throttle is opened from the thrust position into the idling position, the idling system is swept through even at intermediate positions and caused to deliver. As a result, ignitable mixture enters the engine intake pipe and cylinders even before the idling operation injection is reached. The recommencing first combustion in the cylinders takes place with a reduced residual gas component and is especially intensive. Due to the reduced injection, in spite of the intensive combustion, a rise in the average pressures above those in idling operation is avoided, with the result that onset of combustion takes place without a detectable jerk of the vehicle. With a conventional thrust shutting-down using only the fuel feed, the intensive first combustions in the individual cylinders lead to jerking of the vehicle.

The known device has the series disadvantage that the control magnet must overcome the force of the main throttle closure spring below the rotational speed switching threshold. As a result, relatively large electrical control outputs and a powerful control magnet are required, which latter must often remain energized for long periods during idling and is thus expensive and susceptible to failure. The adjustment speed cannot be varied.

SUMMARY OF THE INVENTION

The task of the present invention is so to construct a device of the type mentioned in the introductory category, while avoiding the described disadvantages and while using only small electrical control outputs with relatively simple means, that a satisfactory idling operation and reliable complete closure of the main throttle in thrust operation and when the engine is shut off in idling operation and also in thrust are assured.

To solve the stated task, a device of the type named in the introductory category is characterized according to this invention by an electromagnetic 3/2-way valve comprising a valve outlet which is in flow communication above the speed switching threshold and also when the ignition is shut off with a first valve inlet connected to the engine intake pipe via a non-return valve and, below the rotational speed switching threshold, is in flow communication with a second valve inlet, connected to the surrounding atmosphere or another pressure source, (characterized by) a diaphragm box continually vented at one side of the diaphragm, the control pressure chamber of which at the other side of the diaphragm is connected in flow optionally via a throttle position with the valve outlet and the movable diaphragm of which is mechanically connected with the throttle stop, and by a stop spring which stresses the throttle stop towards the idling minimum open position of the main throttle. In such a device, the electromagnetic 3/2-way valve serves solely for the rotational speed-dependent changing-over of control pressures, so that very small, virtually negligible control outputs are sufficient. In idling operation, the stop spring alone ensures that the closure limitation of the main throttle is limited to an idling minimum opening position. In thrust operation and when the engine is switched off, the available intake pipe suction is utilized for overriding the stop spring in the sense of a complete closure of the main throttle. The non-return valve makes possible, when the engine is shut off, a maintenance of the intake pipe vacuum acting upon the diaphragm box virtually until the engine stops. When the pressure in the intake pipe gradually rises as the engine runs down, the non-return valve closes, so that the suction in the diaphragm box is maintained at least temporarily. The rotational speed switching threshold, in the interests of the maximum possible saving of fuel, is located so near to the idling rotational speed that, at a very steep rotational speed drop (declutching), the switching on again of air and fuel takes place just sufficiently early for the speed not to drop noticeably below the idling rotational speed. If, in the thrust phase, the speed falls below the speed switching threshold and idling operation is again switched on, this operational transition can be achieved without jerking by the prior switching-off of the fuel and air supply in the aforementioned manner. If necessary, by the use of a throttling point in the control pressure line (FIGS. 1 and 7; 54, FIGS. 2 and 3: 86, FIGS. 5 and 6: 124), the adjustment speed can be damped. Since the 3/2-way valve can be governed with very little power and has a pure control function, reliable operation is possible even during long idling times, that is with the 3/2-way valve energized. In addition, the electrical generator of the engine is exceedingly lightly loaded, which is of great importance in idling operation, that is at low speeds.

In a preferred, simple form of embodiment, two fixed movements stops are provided for the diaphragm of a diaphragm box possessing two fixed working points. Here it is possible for a closure of the main throttle and thus interruption of the fuel feed of the idling system and also predominant interruption of the air feed to correspond to the one working point, whereas the other working point represents an idling minimum opening position of the main throttle and thus adjustable idling mixture supply. Such a device is simple and inexpensive and, in spite of the lack of an idling speed regulating function, fully satisfies the expected functions, namely closing of the main throttle in the thrust phase and when the engine is shut off and also a slight opening of the main throttle in idling.

In a further embodiment, a device constructed with an idling speed regulating function and starting function preferably possesses a first throttle position in an interconnecting line connected in parallel to the 3/2-way valve between the first valve inlet and the valve outlet, a second throttle position at the second valve inlet, and furthermore a fixed movement stop for the diaphragm which permits complete closure of the main throttle and a diaphragm intermediate position which occurs during normal idling and which corresponds to the idling minimum open position of the main throttle, from which diaphragm intermediate position the diaphragm, as the intermediate pressure in the control pressure chamber produced by the throttle positions rises, deflects in an additional working range in the opening direction of the main throttle in a speed-regulating manner, and from which (intermediate portion) the diaphragm, when the valve switches over to make communication between the valve outlet and the first valve inlet, moves onto the fixed movement stop. Since the control pressure acting in idling operation upon the diaphragm box is an intermediate pressure dependent upon the intake pipe suction, the diaphragm can, as the idling rotational speed decreases that is as the intermediate pressure rises, be adjusted by the stop spring in the sense of further opening of the main throttle beyond the actual idling position. For example, an idling or transition system of a carburettor can be released to an increasing degree, which in turn results in an increase of the rotational speed with the consequence of a rise in the intake pipe suction. As a consequence, the intermediate pressure again adopts its usual value for normal idling and the diaphragm can move back into its normal idling position. Above the rotational speed switching threshold, the throttle positions do not have any function, since the intake pipe suction can pass directly via the 3/2-way valve to the diaphragm box and pull the diaphragm up against the fixed stop for a complete closure of the main throttle. Also, when the engine is switched off, the throttle positions are inoperative as a consequence of the de-energized 3/2-way valve. They have solely the function of supplying to the diaphragm box during idling, instead of the ambient pressure, an intermediate pressure dependent upon the intake pipe suction, which pressure makes possible a regulating of the idling rotational speed which, for example, may be necessary for compensating the influence of external loadings.

When the engine is stopped, the main throttle is opened beyond the idling position at latest when the ignition voltage is switched on, with the result that in the starting operation the injection is increased and thus the starting and running-up operations are shortened.

In a further embodiment, an intermediate stop, spring-prestressed in the direction of opening of the main throttle and movable between the fixed movement stop and a further fixed stop, is preferably provided, against which the diaphragm or a projection connected therewith bears during normal idling. As a consequence it is possible to predetermine for normal idling a relatively fixed working point, from which the diaphragm can deflect during idling only in the sense of a further opening of the main throttle, if the spring biasing action for the intermediate stop is sufficiently large. In this case, a relatively high pressure jump of the control pressure in the diaphragm box is necessary for deflecting the intermediate stop towards the fixed stop. This pressure jump is not achieved at an only relatively low rise of the idling rotational speed and does not occur until the rotational speed switching threshold is exceeded, when the 3/2-way valve is switched over and the control pressure is changed over from the intermediate pressure to the intake pipe suction. The softer the spring prestress of the intermediate stop is, the smaller will be the pressure jump required for deflecting the intermediate stop.

In one especially simple embodiment, it is preferred to provide at both throttle positions constant throttle cross-sections. Satisfactory functioning of such a device is immediately assured if the throttle cross-sections are always kept clean. Certain problems can, however, occur if the intermediate pressure produced by the throttle positions is modified as a consequence of a partial blocking of the one or the other throttle position. In order to render possile trouble-free, constant idling running even allowing for a possible fouling situation, it is preferred instead to provide a pressure-regulating, variable throttle cross-section of the first throttle position and a constant throttle cross-section of the second throttle position. In this connection it is advantageous to provide a differential pressure regulator with a diaphragm constituting the first throttle position, a spring biases this diaphragm in a control pressure chamber at one side of the diaphragm connected to the engine intake pipe via a non-return valve, a diaphragm chamber on the other side of the diaphragm, a first aperture at the diaphragm chamber, co-operating in flow-throttling manner with the diaphragm or a projection connected therewith and likewise communicating with the engine intake pipe via a non-return valve, and a second opening at the diaphragm chamber connected with the valve outlet. As a consequence thereof it is possible to maintain the intermediate pressure in the diaphragm box which controls during idling at a constant value with respect to the intake pipe pressure, and to achieve this even when partial fouling occurs at the throttle position. The intermediate pressure then always has a value which lies by a constant differential amount above the intake pipe pressure. The magnitude of the pressure difference is determined by the force of the spring and by the effective diaphragm cross-section in the differential pressure regulator.

The described form of embodiment with the rotational speed regulating function during idling has the important advantage that the rotational speed switching threshold can be located relatively near to the set-point of the idling rotational speed, without the speed falling substantially below the set-point during a very steep rotational speed drop (declutching). On account of the low rotational speed switching threshold, a relatively large saving of fuel can be attained in thrust operation.

Even when the device has only two fixed working points (for the normal idling position and for the thrust phase and engine switching-off) and no additional working range for the idling rotational speed regulation, it is fundamentally possible, having regard to the maximum possible fuel savings during thrust operation, to locate the rotational speed switching threshold as close as possible to the idling rotational speed, without the speed falling noticeably below the set-point speed at a very steep speed drop (declutching). For this purpose, it is merely necessary, at the change-over from thrust operation to idling operation, to provide a short-term, that is temporary, additional adjustment of the main throttle. In this connection, a further preferred embodiment is characterized by an auxiliary diaphragm, disposed in the control pressure chamber and partitioning off therefrom a diaphragm intermediate chamber, (characterized) by a throttled flow connection between the control pressure chamber and the diaphragm intermediate chamber, (characterized) by a directly operating auxiliary stop, connecting mechanically with the auxiliary diaphragm and located in front of the indirectly operating throttle stop and movable relative to the latter, which (auxiliary stop) is prestressed to bear against the throttle stop by means of the spring which prestresses the main throttle in the closure direction, and (characterized) by movement stops associated with each other at the diaphragms with a movement clearance between the movement stops when the auxiliary stop bears against the throttle stop. If, during thrust operation, the intake pipe suction predominates in the control pressure chamber and also via the flow communication also in the diaphragm intermediate chamber, then the diaphragms, their movement stops bearing against each other, bear against the fixed stop of the diaphragm box which is responsible for the fully closed position of the main throttle. If, when the speed falls below the rotational speed switching threshold, the atmospheric pressure is let into the control pressure chamber, then the diaphragms move, without any change in their relative positions, to the fixed stop of the diaphragm box which is responsible for a maximum main throttle minimum opening position. The ambient pressure can at first act gradually in the diaphragm intermediate chamber via the throttled flow communication, whereafter the spring which prestresses the main throttle in the closure direction can push back the auxiliary stop until it bears against the throttle stop, which corresponds to a reduction of the main throttle minimum opening position down to the normal idling setting. Such a device thus possesses two fixed or stationary working points and one non-stationary working range for the operational transition from thrust to idling operation.

In a device of the aforementioned type constructed with such an auxiliary stop, there are furthermore preferably provided a connecting rod connected with the diaphragm, conducted outwardly and formed as a guide sleeve and having an annular throttle stop at its end, and a rod, connected with the auxiliary diaphragm and passing through the guide sleeve to the auxiliary stop. Such a form of construction is compact, stable and, on account of the mutual guiding, operationally reliable.

If a further embodiment of the device equipped with an auxiliary stop, this device possesses an electromagnetic 2/2-way valve in a line connecting the diaphragm intermediate chamber with the engine intake pipe, and a control for opening the 2/2-way valve when the speed falls sufficiently below the idling rotational speed or when a switch contact is actuated as the gear stage is engaged or the air conditioning plant is switched on. Preferably, the control for the 2/2-way valve here possesses a rotational speed hysteresis with a switching-on point below the idling set-point speed and a switching-off point above it. This device renders possible, when the idling rotational speed for example falls by a specific amount due to an external loading, a communication between the diaphragm intermediate chamber and the suction side of the intake pipe, as a consequence of which the main throttle is opened somewhat further during idling from the normal idling position, by the value of the movement clearance present between the movement stops of the diaphragms. As a result, a rotational speed drop can be compensated and the rotational speed hysteresis of the control prevents a too frequent switching-over of the 2/2-way valve. Such a device does indeed not permit an exact rotational speed regulation, but it renders possible at low expense a limitation of the idling rotational speed below the idling set-point speed.

According to a further embodiment, the device possesses a diaphragm movable between two movement stops, an auxiliary diaphragm disposed in the vented diaphragm chamber and partitioning off therefrom a diaphragm intermediate chamber communicating with the engine intake pipe via a non-return valve and having a diaphragm rod fixed to the auxiliary diaphragm and projecting from both sides thereof, the ends of which rod can come into bearing engagement on the one hand with the indirectly operating throttle stop at the diaphragm and on the other hand, as auxiliary stop, with a part of the main throttle, a compression spring clamped between the diaphragm and the auxiliary diaphragm, and a starting operation stop, up to which the auxiliary diaphragm shall be moved forward until the engine start and thereafter shall be moved forward as the rotational speed drops by means of the compression spring in the sense of an additional increase in the main throttle minimum opening position.

In such a device, the prestressed auxiliary diaphragm with the diaphragm rod, which is functionally incorporated between the main throttle and the throttle stop at the diaphragm, renders possible for the starting operation and thereafter when there is a sufficient rotational speed drop or pressure rise in the engine intake pipe, a spring-dependent, further opening of the main throttle. When, indeed, the suction in the diaphragm intermediate chamber is lacking or is sufficiently small, the compression spring can move forward the auxiliary diaphragm with the diaphragm rod and the auxiliary stop at the front side relative to the diaphragm with the throttle stop and thus further open the main throttle. In this way the starting operation is favoured. Furthermore, a certain regulating effect for the idling rotational speed is hereby obtained, since when this speed falls the main throttle is further opened and thus the rotational speed can again rise. This regulating effect may also be utilized for rotational speed correction when there is an altitude effect and during the switching on of auxiliary consumers, such as an air conditioning plant. Whereas the diaphragm thus operates with the throttle stop between its two movement stops for the closure position and the minimum opening position of the main throttle, the auxiliary diaphragm is capable of increasing this minimum open position still further whenever the suction in the diaphragm intermediate chamber falls by a sufficient amount.

In this form of embodiment, it is furthermore advantageous to provide an adjustable movement stop associated with the diaphragm for the maximum closed state of the main throttle and/or an adjustable starting operation stop and/or an adjustable idling setting. These measures make possible separate settings for thrust function, iding function and starting function. It is accordingly possible to modify the maximum closed state for the thrust operation, the extended minimum open position for the starting operation and the idling setting, aand also to adapt them to the current operating conditions in an appropriate manner. For the adjustable, maximum closure limitation, there may be used a longitudinally adjustable, hat-shaped thrust setting screw, serving as movement stop for the main throttle closed state, into the guide opening of which (setting screw) a guide shank of the diaphragm engages longitudinally displaceably. This has the advantage of a multiple utilization of the thrust setting screw, firstly as a guide means and secondly as a variable stop means. For the variable starting operation setting adjustment, a longitudinally adjustable, sleeve-shaped starting operation setting screw, constituting at one end the starting operation stop, may be used, through which a portion of the diaphragm rod is guided in a longitudinally displaceable manner out of the diaphragm box. This setting screw also has a multiple function, namely on the one hand as guide means and on the other hand as a variable stop means for limiting the forward movement of the auxiliary diaphragm which takes place in the direction of opening of the main throttle. It is also possible to use as idling setting means a longitudinally adjustable idling setting screw, pressed onto the auxiliary stop of the diaphragm rod by means of the main throttle prestress acting in the closure direction, this setting screw being on a lever connected with the main throttle. By means of this idling setting screw, the idling basic setting of the main throttle can be varied in a simple manner.

Finally, it is preferred in this embodiment to use a compression spring, clamped in the control pressure chamber of the diaphragm box between the diaphragm and the wall of the diaphragm box, as a stop spring which presses the throttle stop towards the idling minimum open position of the main throttle. This stop spring is thus situated, not as in the other forms of embodiment outside, but instead inside the diaphragm box, so that the device, in spite of its additional functions, can be constructed compact and space-saving.

Preferably, the device possesses an electronic control for energizing the 3/2-way valve when the ignition voltage is applied and at a rotational speed below the rotational speed switching threshold. In a further embodiment, the electronic control can execute an engine temperature-dependent, opposed change of the rotational speed switching threshold. Such an electronic control is simple, inexpensive and operationally reliable. It needs to generate only the control current for the electromagnetic 3/2-way valve and can thus be of low output. By means of the temperature-dependent change to the rotational speed switching threshold, assurance can be provided even when the engine has not heated up that, when a steep rotational speed drop (declutching) occurs, the speed does not fall inadmissibly below the idling rotational speed. For this purpose, the rotational speed switching threshold is placed higher as the engine temperature is lowered, since, as the temperature falls, the frictional power rises and a delayed mixture preparation results as a consequence of cold intake pipe walls.

If, for the aforementioned reasons, a 2/2-way valve is also present, it is preferred to provide a common electronic control for the 3/2-way valve and the 2/2-way valve. In this case, the control has two defined rotational speed switching thresholds, namely a rotational speed switching threshold for the 3/2-way valve above the idling rotational speed at, for example, 1500 rpm, and a rotational speed switching threshold for the 2/2-way valve below the idling rotational speed. The switching-on threshold for the 2/2-way valve may, for example, be situated by a value of 50 rpm below the idling speed set-point of, for instance, 800 rpm, whereas the switching-off threshold is located, for instance, at 900 rpm. This hysteresis renders possible a limitation of the idling speed of 50 rpm below the idling speed set-point and prevents excessively frequent switching of the 2/2-way valve. If there is a sufficient gap between the rotational speed switching threshold for the 3/2-way valve and the idling speed set-point, then a switching-over of the 3/2-way valve takes place only when the upper rotational speed switching threshold is passed through, but not in the idling range.

The device according to the present invention is suitable especially for carburettors having an idling system, the mixture outlet region of which is swept by the main throttle and is disposed upstream thereof in the closed state thereof. The device is, however, suitable basically also for other carburettors which as a rule do not possess any special idling system, such as for constant pressure carburettors. In this connection, a movement stop for the air valve approximately adjacent to the idling setting of the air valve of a constant pressure carburettor is preferably provided, this being for an interruption of the vacuum-caused fuel feed in the case of a closure of the main throttle which goes beyond the idling position. Whereas normally in the mixing chamber of a constant pressure carburettor an approximately constant pressure is maintained by the displacement of the air valve, this pressure must of necessity fall when the air valve movement is limited and the air throughput further decreases. This operation can be utilized in conjunction with the device according to the present invention for the purpose of interrupting the fuel supply at a closure of the main throttle. From this it is apparent that the device can be utilized advantageously not only in fixed air funnel carburettors but also in constant pressure carburettors. The invention is explained in more detail below with reference to examples of embodiment thereof illustrated in the drawings. The drawings show:

In the various embodiment, which sometimes differ only by slight modifications, mutually corresponding components have the same references and are sometimes described only once.

Figure 1:
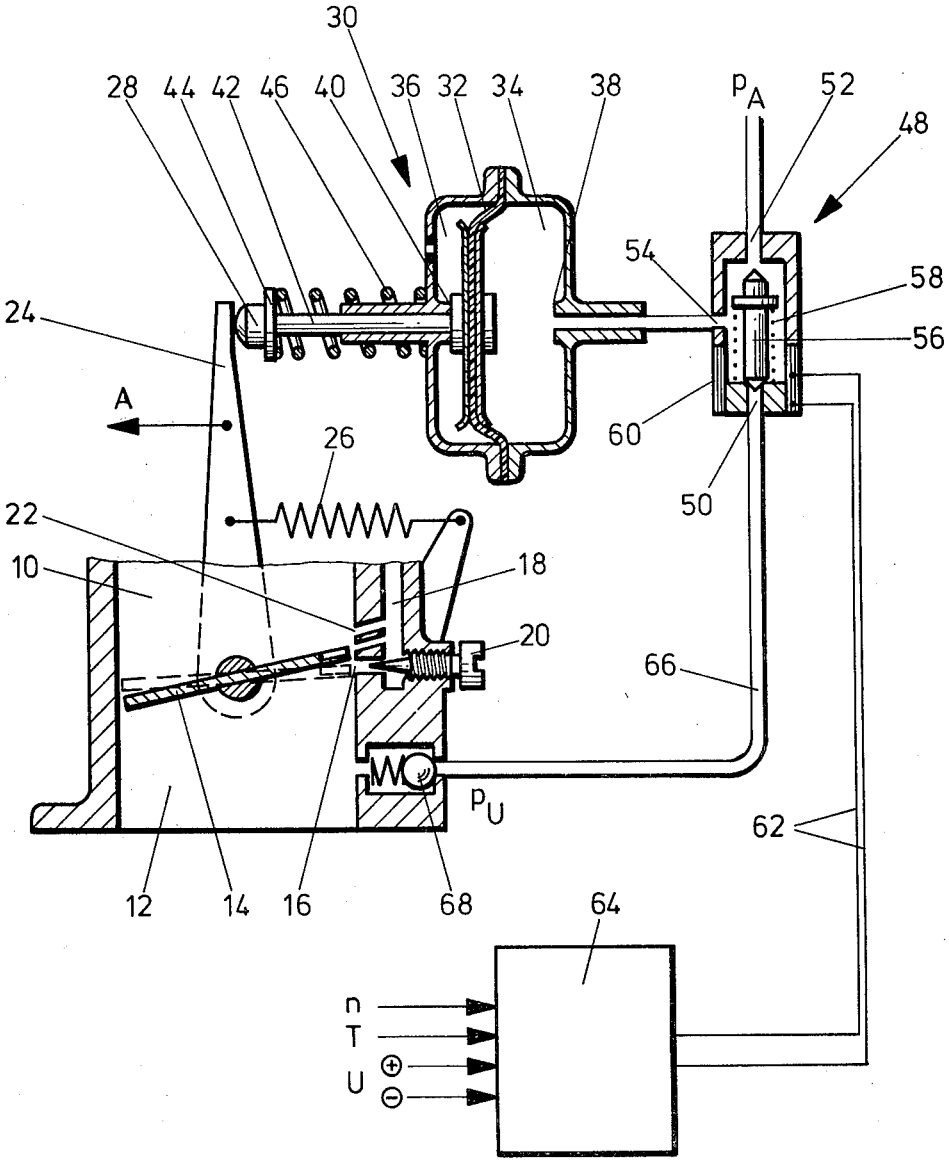
FIG. 1 in a diagrammatic view, a device according to the present invention in accordance with an especially simple first embodiment thereof without regulation of the idling rotational speed and without auxiliary opening of the main throttle during the starting and running-up operation.

In FIG. 1, a partially illustrated carburettor, for example a fixed air funnel carburettor, possesses a mixing chamber 10, which is adjoined in the flow direction by an engine intake pipe 12 and which is separated therefrom by a main throttle 14, constituted in the present case as a pivotal throttle damper. In the fully closed position of the main throttle 14 indicated in broken line, an outlet bore 16 of an idling system connected with a mixture duct 18 is situated upstream of the main throttle 14. This means that the suction obtaining in the engine intake pipe 12 cannot act in the closed position of the main throttle 14 upon the idling system, so that with the main throttle 14 closed, the fuel supply of the idling system is interrupted and the air supply is also interrupted except for small leakage rates. This operating state applies to the thrust phase and for engine shutdown during thrust and idling.

In normal idling, the main throttle 14 is pressed out of the dotted closed position, to an extent limited by stops, into the idling minimum open position indicated in full line, at which the outlet bore 16 becomes situated downstream of the main throttle 14 and thus the idling mixture supply, adjustable by means of a setting screw 20, can commence due to the suction in the engine intake pipe 12. Transition bores 22 connected with the mixture duct 18 become situated, as the main throttle 14 opens further, in the region downstream of the main throttle and in the suction region, which is of importance especially in acceleration processes and for idling rotational speed regulating operations.

The main throttle 14 is connected to a lever 24, which is pre-biased by a spring 26 in the closing direction of the main throttle 14, the closing movement being limited by the contact of the lever 24 against a throttle stop 28. The opening of the main throttle 14 is effected by the application of an external force in the direction of arrow A against the action of the spring 26 which, when this force is absent, is capable of closing the main throttle 14 to a greater or lesser extent depending upon the position of the throttle stop 28.

The throttle stop 28 is a component of a diaphragm box 30, operating as an actuating element, the internal space of which is subdivided by a diaphragm 32 into a control pressure chamber 34 and a vented diaphragm chamber 36. The diaphragm 32 has two fixed working points, on the one hand when bearing against a fixed movement stop 38 for the completely closed position of the main throttle 14 and on the other hand when bearing against a fixed movement stop 40 for the partially opened, idling position of the main throttle 14. The diaphragm 32 is connected, via a connecting rod 42 passing out from the diaphragm box 30, with a disc 44 and the throttle stop 28 fixed thereto. A stop spring 46, surrounding the connecting rod 42, is stressed between the disc 44 and a stationary component, such as the casing of the diaphragm box 30, in such a manner that the throttle stop 28 is biased in the direction of opening of the main throttle 14. When a sufficient vacuum is not present in the control pressure chamber 34, the stop spring 46 thus presses the diaphragm 32 against the fixed movement stop 40, and in this position the throttle stop 28 adopts the idling position corresponding to the position of the main throttle 14 illustrated in full line. The stop spring 46 must be sufficiently hard so that it can not be overcome by the spring 26.

An electromagnetic 3/2-way valve 48 possesses a first valve inlet 50, a second valve inlet 52 opposite thereto, and a valve outlet 54, which is connected via a connecting line not further referenced, optionally comprising a throttling position, with the control pressure chamber 34 of the diaphragm box 30, for example in the region of the fixed movement stop 38. In the 3/2-way valve 48 there is a closure body 56, displaceable in its longitudinal direction, which can seal alternately with its two conical ends the valve inlets 50 and 52. The closure body 56 is pressed by a valve spring 58 in such a way that it normally seals the second valve inlet 52. The electromagnetic 3/2-way valve 48 furthermore possesses a coil 60, which when energized by means of an electronic control 54 via an electrical conductor 62, magnetically pulls up the closure body 56 so that the latter is caused to close the first valve inlet 50 in opposition to the action of the spring 58. The first valve inlet 50 is so connected via a line 66 and a non-return valve 68 with the engine intake pipe 12 so that the non-return valve 68 is opened only when a sufficient vacuum exists in the engine intake pipe 12. The second valve inlet 52 is connected via a line, not referenced here, with the ambient atmosphere, preferably with the clean air side of the air filter.

The device of FIG. 1 is illustrated in its idling state, in which the input conditions are satisfied for the electronic control 64, so that the ignition voltage U is applied and the rotational speed n is smaller than a predetermined, preferably adjustable rotational speed switching threshold of, for instance, 1500 rpm. In this state, the electronic control 64 generates an energizing control current for the coil 60 of the 3/2-way valve 48, so that the closure body 56 seals the first valve inlet 50 in opposition to the action of the valve spring 58 and opens the second valve inlet 52.

In this way the ambient pressure reaches the control pressure chamber 34, and the stop spring 46 can press the main throttle 14, via the throttle stop 28, into the illustrated idling position.

As soon as the rotational speed n is greater than the rotational speed switching threshold, the control current for the coil 60 drops out and the closure body 56 opens the first valve inlet 50 by means of the valve spring 58 and seals the second valve inlet 52. Thus the control pressure chamber 34 is always subjected to the suction $P_u$ in the engine intake pipe 12 above the rotational speed switching threshold. The vacuum ensures that the diaphragm 32 is pulled back against the action of the stop spring 46 as far as the fixed movement stop 38 and thus the throttle stop 28 arrives in the position corresponding to the fully closed position of the main throttle 14. In this way the main throttle 14, in the thrust phase (accelerator pedal released) above the rotational speed switching threshold, will always close as far as the fully closed position indicated in broken line, in which the air feed is largely interrupted and the fuel feed completely interrupted. As soon as the speed falls below the rotational speed switching threshold during thrust operation, a change-over of the 3/2-way valve 48 takes place with the result of venting of the control pressure chamber 34, so that the main throttle 14 is pressed into the idling position, in order thereby to avoid the speed falling below the idling rotational speed or, indeed, the engine stopping. This transition from the thrust phase into the idling phase takes place in the initially mentioned manner softly and without any jolt, since in the thrust phase not only the fuel feed but also predominantly the air feed has been interrupted. For the purpose of damping the adjustment speed, a throttle point (not illustrated) can be incorporated into the control pressure line of the control pressure chamber 34.

According to the illustration in FIG. 1, the engine temperature T can also be introduced as an input parameter to the electronic control 64, for raising the rotational speed switching threshold as the temperature falls and vice versa. Consequently the result can be attained that, with a rapid fall in rotational speed (declutching) and cold engine, no inadmissible drop of the speed below the idling rotational speed occurs. On the other hand, when the engine is hot the switching threshold can be positioned nearer to the idling rotational speed, in order to utilize to the optimum the possible fuel saving in the thrust phase. If necessary, other operating parameters can also be taken into account.

If, in the idling phase or in the thrust phase, a shutting-off of the engine is effected and thus the ignition voltage U as an input condition for the electronic control 64 drops out, the control pressure chamber 34 is connected with the first valve inlet 50. As a result the main throttle 14 arrives in its fully closed position when the engine is shut down. In order that, as the engine runs down, the pressure rising in the engine intake pipe 12 shall not be able to permit an adjustment of the diaphragm 32 in the sense of opening the main throttle 14, the non-return valve 68 ensures a flow separation between the engine intake pipe 12 and the pipe 66 when the pressure difference between the engine intake pipe 12 and control pressure chamber 34 reverses. In this manner a sufficient vacuum can be maintained in the control pressure chamber 34 at least until the engine has come to a stop. A subsequent gradual opening of the main throttle 14 as far as the idling position is not critical.

Figure 2:
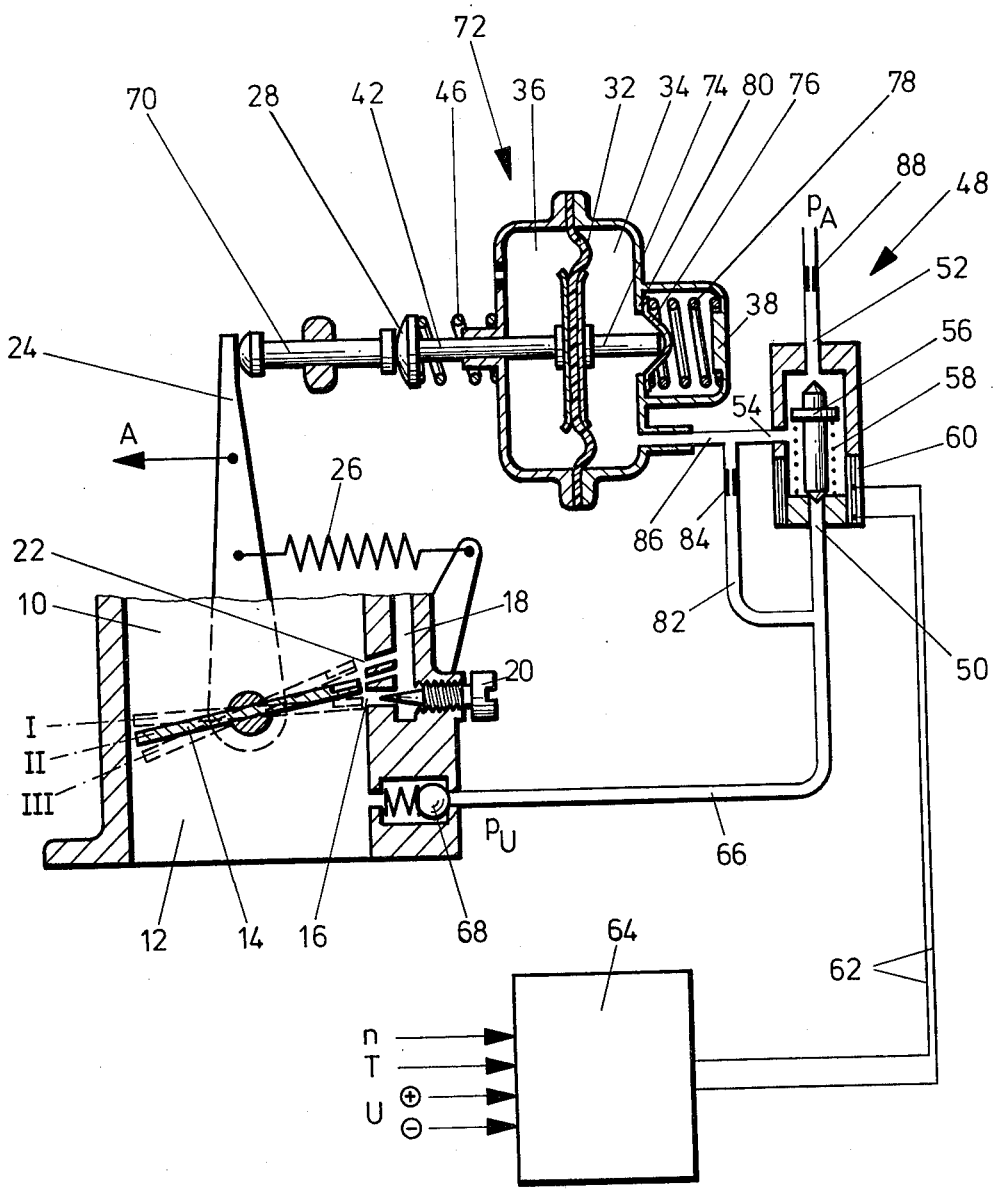
FIG. 2 in a diagrammatic view, a somewhat modified second embodiment of the device according to the present invention, with a control of the idling rotational speed and auxiliary opening of the main throttle during the start and running-up operation.

The second embodiment of FIG. 2 differs from the first embodiment of FIG. 1 essentially only by a modified diaphragm box 72 and two additional throttle positions for generating an intermediate pressure in idling running, in order to render possible a regulation of the idling rotational speed and an additional opening of the main throttle 14 at starting and running-up. Consequently, only the differences from the embodiment of FIG. 1 will be explained. In a slightly modified manner, the throttle stop 28 does not act directly, as in FIG. 1, but via a slidably mounted intermediate element 70 upon the lever 24. The diaphragm box 72 has a fixed movement stop 38, against which the diaphragm 32 comes to bear via a rod-shaped projection 74 and a movable intermediate stop 76 with compression of a spring 78, when the control pressure in the control pressure chamber 34 adopts a sufficiently large vacuum value, i.e. when the valve outlet 54 of the 3/2-way valve 48 is connected with its first valve inlet 50.

The intermediate stop 76 is pressed, during idling, by the spring 78 against a fixed stop 80, and the projection 74 of the diaphragm 32 bears during idling against the intermediate stop 76.

As a difference from the embodiment of FIG. 1, in FIG. 2 it is not ambient pressure which obtains in the control pressure chamber 34 during idling, but an intermediate pressure between the intake pipe suction and the ambient pressure. This intermediate pressure is produced, according to FIG. 2, by a first throttle position 84 in a connecting line 82 between the valve outlet 54 and the line 66 and by a second throttle position 88 at the second valve inlet 52. When, during idling, the closure element 56 produces a flow communication between the second valve inlet 52 and the valve outlet 54, ambient air is sucked via the throttle positions 84, 88 through the line 66 into the engine intake pipe 12. Consequently, there occurs at the valve outlet 54 and in a line 86, connected therewith and leading to the control pressure chamber 34, the aforementioned intermediate pressure. The throttle positions are so dimensioned that in normal idling operation such an intermediate pressure arises that, by its difference from the pressure in the vented diaphragm chamber 36, a force is produced at the diaphragm 32 which can overcome or compress the stop spring 46 so that the diaphragm 32 is brought by the projection 74 into bearing against the intermediate stop 76.

In the case of an engine shut-down in the thrust phase or in the idling phase, a switching-over of the 3/2-way valve 48 occurs, so that the full intake pipe suction passes via the line 86 into the control pressure chamber 34 and the second valve inlet is closed. As a consequence, the diaphragm 32 can move against the force of the stop spring 46 and against the force of the spring 78 into bearing against the fixed movement stop 38, as a consequence of which complete closure of the main throttle 14 as far as position I is possible. With the help of the non-return valve 68, here again complete running-down of the engine is achieved before the main throttle is pressed, as the suction in the control pressure chamber 34 drops, into the idling position II.

If, in the thrust phase, the speed falls below the aforementioned rotational speed switching threshold of, for example, 1500 rpm and the 3/2-way valve 48 adopts the position illustrated in FIG. 2, then instead of the full intake pipe suction, the intermediate pressue now arrives in the control pressure chamber 34 and the main throttle 14 adopts the idling position II. If the engine has not heated up, that is there is increased friction, or when a load is switched on during idling (engaging of the gear in automatic gears and/or switching-on of the air conditioning plant), the idling rotational speed falls noticeably, with the risk of the engine stalling. In order to avoid this rotational speed drop, there exists in the device of FIG. 2 the possibility of opening the throttle stop 28 and thus the main throttle 14 further beyond the idling position up to at maximum the position III, as a consequence of which, for example, the transition bores 22 also come into the suction range and more mixture is sucked in. This further opening from position II to a maximum of position III is effected by a rise in the intake pipe pressure as the rotational speed falls and by corresponding rise of the intermediate pressure in the control pressure chamber 34. As a consequence, the pressure difference at the diaphragm 32 is no longer sufficient for compensating the force of the stop spring 46, and the diaphragm 32 deflects, as far as a new equilibrium, with relieving of the stop spring 46 and further opening of the main throttle 14. The projection 74 now becomes disengaged from bearing against the intermediate stop 76. By appropriate dimensioning of the stop spring 46 in relation to the characteristic, the result can be attained that the idling rotational speed, when the load of the engine is increased, does not or does not appreciably fall below the rotational speed set-point in idling. Consequently, the device of FIG. 2 likewise has two fixed working points (for the thrust phase and the engine switching-off and for the normal idling position) and one additional working range, which is available for the speed-controlling opening of the throttle damper beyond the idling position.

In the at-rest position, the position III is reached, which is also maintained during starting and at the commencement of running-up.

Figure 3:
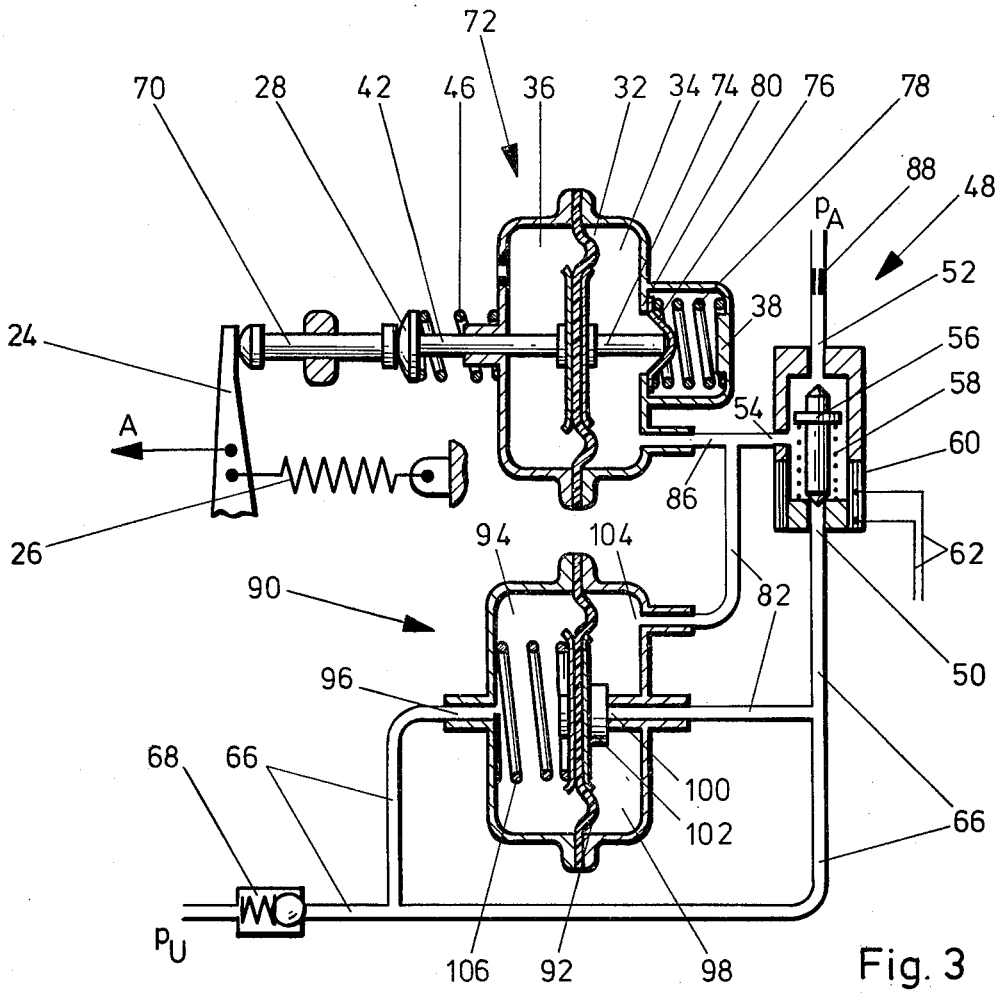
FIG. 3 in a diagrammatic view, a third embodiment of the device according to the present invention, which compared with the second embodiment possesses, instead of a fixed throttle position, a pressure-regulating, variable throttle position.

The third form of embodiment of FIG. 3 differs from the second form of FIG. 2 virtually only in a different form of the first throttle position, which is replaced in FIG. 3 by a differential pressure regulator 90. This ensures that the intermediate pressure at the line 86 leading to the control pressure chamber 34 always lies by a constant amount above the pressure in the engine intake pipe 12.

As a consequence, and as a difference from the embodiment of FIG. 2, impurities at the throttle positions are prevented from leading to a direct change in the intermediate pressure value and thus to a change in the idling setting.

The differential pressure regulator 90 of FIG. 3 possesses a diaphragm 92, which separates a control pressure chamber 94 from a diaphragm chamber 98. The control pressure chamber 94 is connected via an inlet 96 with the line 66 leading to the engine intake pipe 12. The diaphragm chamber 98 possesses a first opening 100, which co-operates with a disc-shaped projection 102 of the diaphragm 92 as variable throttle position or pressure regulating valve in the connecting line 82 between the first valve inlet 50 and the valve outlet 54. Thus, in idling, atmospheric air can be sucked into the engine intake pipe 12 via the second throttle position 88, the line 86, the connecting line 82, a second opening 104 of the differential pressure regulator 90 leading to the diaphragm chamber 98, the first opening 100 and the continuation of the connecting line 82 and also the line 66, whereby a constant pressure drop occurs at the first throttle position, which is formed by the first opening 100 and the projection 102, since the diaphragm 92 is suitably biased by means of a spring 106 towards the closure position of the first opening 100. When atmospheric air is sucked in via the two throttle positions (during idling), a pressure becomes established in the diaphragm chamber 98 of the differential pressure regulator 90 which lies by a constant value above the pressure in the control pressure chamber 94. The magnitude of the pressure difference is determined by the force of the spring 106 and the effective cross-section of the diaphragm 92. The pressure in the diaphragm chamber 98 which becomes established during idling corresponds to the intermediate pressure which is also active in the control pressure chamber 34. This is, however, considerably more stable than the form of embodiment of FIG. 2 in respect of fouling influences.

Figure 4:
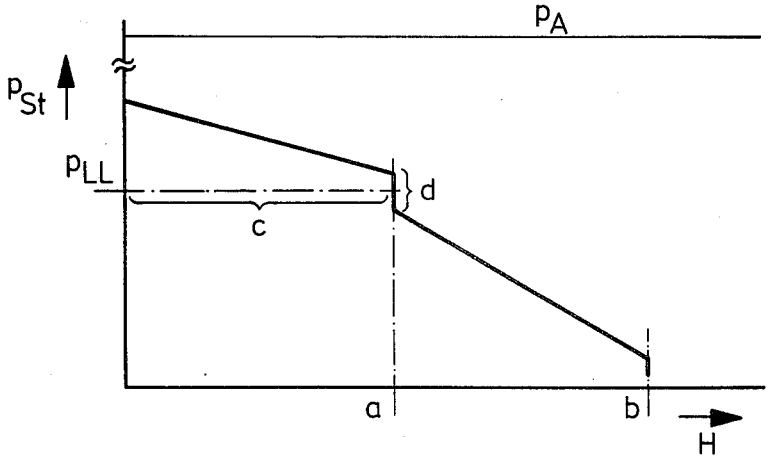
FIG. 4 in a diagram, the dependence between the absolute control pressure in the diaphragm box and the adjustment stroke of same for the second and third embodiments.

In FIG. 4, the basic dependence of the stroke H of the diaphragm box 72 upon the absolute control pressure $P_{St}$ in the control pressure chamber 34 is plotted for the second and third forms of embodiment. With falling control pressure, there occurs from a specific pressure value onwards, a deflection of the diaphragm 32 together with connecting rod 42 and throttle stop 28 against the force of the stop spring 46 and towards the right, as far as the situation of the idling setting with bearing of the projection 74 against intermediate stop 76. Since the spring 78 presses the intermediate stop 76 under prestress onto the fixed stop 80, a pressure jump d is necessary in the idling setting in order to deflect the diaphragm 32 further towards the right against the force of the spring 78. The prestressing force of the spring 78 determines the magnitude of the necessary pressure jump in the idling position. The stroke range between the idling position a and the position b in the thrust range or when the engine is shut off is suddenly swept through after the 3/2-way valve 48 switches over. In the working range c, with the engine idling under load, any intermediate or stroke position of the diaphragm box 72, operating as actuating element, can be maintained according to the deviation of the controlling intake pipe pressure $P_{St}$ from the normal idling intake pipe pressure $P_{LL}$. The desired operating conditions can be maintained by appropriate dimensioning of the stop spring 46 in relation to the effective area of the diaphragm 32.

Figure 5:
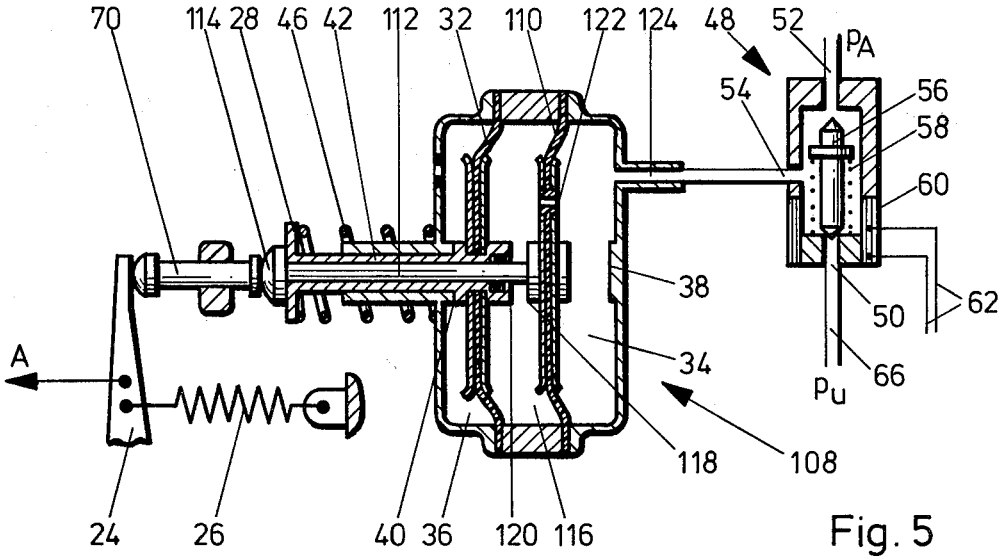
FIG. 5 in a diagrammatic view, a fourth embodiment of the device according to the present invention comprising an auxiliary diaphragm for an additional, non-steady adjustment of the main throttle.

The fourth embodiment of FIG. 5, in which likewise an intermediate element 70 is provided as in the embodiments according to FIGS. 2 and 3, differs from the embodiment of FIG. 1 in other respects only by the construction of the diaphragm box 108. The diaphragm 32 is here connected with a sleeve-shaped connecting rod 42, constituted as guide rod, which is equipped at one end with an annular, indirectly operating throttle stop 28. The stop spring 46 surrounds the connecting rod 42 and is stressed between the throttle stop 28 and the diaphragm box 108. The control pressure chamber 34 of the diaphragm box 108 is partitioned off by an auxiliary diaphragm 110 from the diaphragm intermediate chamber 116 between the diaphragms 32 and 110. A rod 112, conducted outwardly through the sleeve-shaped connecting rod 42, is connected with the auxiliary diaphragm 110 and carries at its end an auxiliary stop 114, which can be pressed by the spring 26 which closes the main throttle 14 via the intermediate element 70 against the throttle stop 28. The mutually facing sides of the diaphragms 32, 110 are formed with movement stops 118, 120, between which, when the auxiliary stop 114 bears against the throttle stop 28, a movement clearance is present. The auxiliary diaphragm 110 is constructed with a throttled flow communication 122 in the form of a diaphragm aperture connecting the control pressure chamber 34 with the diaphragm intermediate chamber 116. The control pressure chamber 34 is connected via an inlet 124 and a line, not referenced here, with the valve outlet 54 of the 3/2-way valve 48.

The form of embodiment of FIG. 5 possesses, as in the embodiment of FIG. 1, only two stationary working positions, namely one position with bearing against the fixed movement stop 38 for the thrust phase and engine switched-off, and one position with bearing against the fixed movement stop 40 for the idling phase. Since, when there is a steep speed drop (declutching), there is a risk of the speed falling briefly below the idling rotational speed, it is necessary either to place the rotational speed switching threshold for the opening adjusting of the main throttle 14 in the idling position higher (for example as a function of the engine temperature T), or, if no idling rotational speed control is present as in the embodiments according to FIGS. 2 and 3, to open the main throttle at least temporarily beyond the idling position after the speed has fallen below the rotational speed switching threshold, in order then to bring it back slowly into the normal idling setting. The last-named possibility is realized in the fourth embodiment according to FIG. 5.

In the idling operation illustrated in FIG. 5, atmospheric pressure obtains in the control pressure chamber 34 and, via the throttled flow communication 122, also in the diaphragm intermediate chamber 116. The stop spring 46 has pressed the throttle stop 28 towards the left until the diaphragm 32 bears against the fixed movement stop 40. The spring 26 ensures that the auxiliary stop 114 bears against the throttle stop 28 and thus a movement clearance is present between the movement stops 118, 120 of the diaphragms 32, 110. In this state, the main throttle 14 adopts its normal idling position.

When the rotational speed switching threshold is exceeded and with the engine shut off, the 3/2-way valve 48 ensures that the intake pipe vacuum $P_u$ extends into the control pressure chamber 34, causing the two diaphragms 32, 110 to be moved towards the right against the force of the stop spring 46 in the direction of closure of the main throttle as far as bearing against the fixed movement stop 38. As a consequence, the main throttle is closed, during thrust and when the engine is shut off, sufficiently far for the air through-put to be reduced except for small leakage rates and for the fuel throughput to be interrupted. During thrust operation, a pressure balancing takes place between the control pressure chamber 34 and the diaphragm intermediate chamber 116, so that the diaphragm 32 is moved further towards the right against the force of the stop spring 46, until the movement stops 118, 120 of the diaphragms 32, 110 come into mutual bearing. In this relative movement of the diaphragms, no positional change of the auxiliary stop 114, which is hereby connected with the stationary auxiliary diaphragm 110, takes place. If the speed falls below the rotational speed switching threshold, therefore, during switching over from thrust operation to idling operation, the 3/2-way valve 48 assures venting of the control pressure chamber 34 and also in a delayed manner of the diaphragm intermediate chamber 116. Initially, both the diaphragms 32 and 110, with mutual bearing of their movement stops 118 and 120, are moved towards the left as far as the fixed movement stop 40, with the consequence that the main throttle 14 is opened beyond its normal idling position. With increasing pressure balancing between the control pressure chamber 34 and the diaphragm intermediate chamber 116, the auxiliary diaphragm 110 is pressed somewhat towards the right by the spring 26 via the intermediate element 70 and the rod 112, until the auxiliary stop 114 comes to bear against the throttle stop 28. In this condition, the main throttle 14 adopts its normal idling position. It is thus possible, by such a temporary, nonsteady auxiliary opening adjustment of the main throttle 14 when switching over from thrust operation to idling operation, to prevent a fall of rotational speed to values below the idling speed and to bring the rotational speed switching threshold nearer to the idling rotational speed, in order in this manner to achieve, in the thrust phase, a further fuel saving effect by extending the switching-off periods of the fuel supply.

Figure 6:
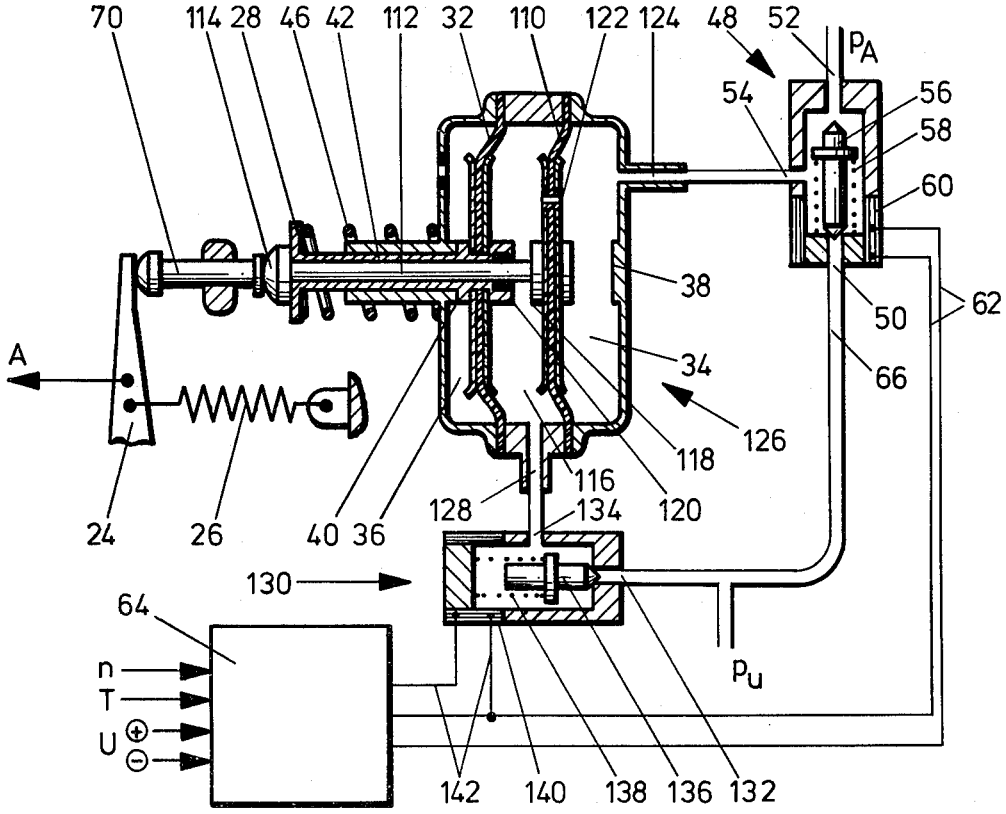
FIG. 6 in a diagrammatically illustrated fifth embodiment, a variant of the fourth embodiment comprising an additional 2/2-way valve for a pressure control between the diaphragms.

The fifth embodiment of FIG. 6 differs from the fourth embodiment of FIG. 5 virtually only in a somewhat modified diaphragm box 126 and an additional 2/2-way valve 130, by which it is possible to modify the pressure in the diaphragm intermediate chamber 116 also in a steady manner. The 2/2-way valve 130 is situated in a line 128, which connects the line 66 with a nonreferenced inlet to the diaphragm intermediate chamber 116 of the diaphragm box 126. The 2/2-way valve 130 possesses a valve inlet 132, a valve outlet 134, a closure element 136 acting upon the valve inlet 132, a valve spring 138 biasing the closure element 136 in the closure direction, and a coil 140 which is connected via an electrical conductor 142, for example, to the electronic control 64. This control 64 has, as a difference from the controls used in the previous embodiments, two defined rotational speed switching points, namely on the one hand the already mentioned rotational speed switching threshold of, for instance, 1500 rpm, and on the other hand an additional rotational speed switching threshold, which is situated somewhat below the idling set-point speed, for example by about 50 rpm below the idling set-point rotational speed of, for instance, approximately 800 rpm.

When the speed falls below the idling set-point rotational speed and the auxiliary rotational speed switching threshold, the normally closed 2/2-way valve 130 is opened by electrical controlling of its coil 140, so that the intake pipe suction $P_u$ passes directly into the diaphragm intermediate chamber 116. As a consequence it is possible to move the auxiliary diaphragm 110 out of the normal idling position illustrated in FIG. 6 towards the left, until the movement stop 118 bears against the movement stop 120 and the auxiliary stop 114 has moved away from the throttle stop 28 by the movement clearance. In this operating state, the main throttle 14 is adjusted beyond its normal idling setting in the opening direction, with the result that a rise in the idling rotational speed (of, for example, 200 rpm with the unloaded engine) is attained. By this controlled additional adjustment of the main throttle, it is possible, when the engine is loaded in idling, to limit a drop of the idling rotational speed to a specific value of, for example, 50 rpm. This does indeed not assure any accurate regulation of the idling rotational speed to the set-point speed, but this is a simple measure for a defined limiting of the idling rotational speed below the set-point of idling speed. In order to avoid a too frequent switching of the 2/2-way valve 130, it is advantageous to provide a switching hysteresis and to make the speed interval between the switching-on and switching-off points sufficiently large for the additional adjustment of the main throttle not to be cancelled until an idling rotational speed of, for example, 900 rpm has been exceeded. The governing of the 2/2-way valve 130 may also be provided directly by switching contact, for example when the gear stage is actuated in vehicles with automatic gears, or when the air conditioning plant is switched on and off.

The sixth embodiment according to FIG. 7 differs from the embodiment according to FIG. 1 basically by the construction of the diaphragm box 180, so that only the deviations in this respect will be described below. In other respects, the spring 26 is clamped between the lever 24 on the one hand and the diaphragm box 180 on the other hand, the line 66 connected with the engine intake pipe 12 is equipped with a branch leading to the diaphragm box 180, and at the lever 24 an idling setting screw is fitted, which will be described in more detail below.

Figure 7:
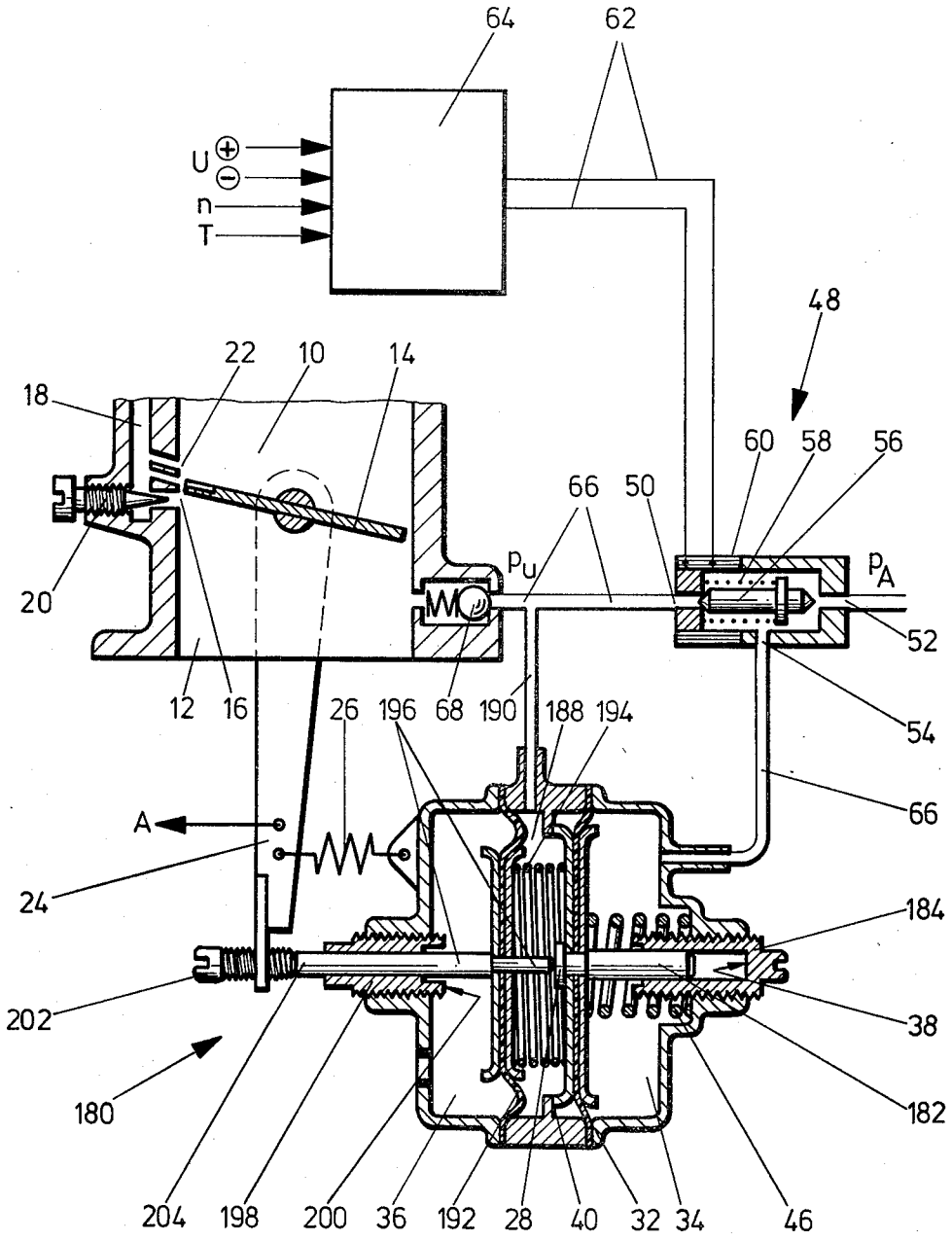
FIG. 7 in a diagrammatic view, a sixth embodiment of the device of the present invention, comprising an auxiliary diaphragm for an additional adjustment of the main throttle at the start and as the idling rotational speed falls.

According to FIG. 7, the throttle stop 28 is located directly in the central region of the diaphragm 32 at the front end of a guide shank 182, which engages longitudinally displaceably at the rear inside the control pressure chamber 34 of the diaphragm box 180 in a central depression of a hat-shaped, longitudinally adjustable thrust setting screw 184. The diaphragm 32 can move between the movement stop 38 at the end of the adjustable thrust setting screw 184 and the fixed movement stop 40 in the longitudinal direction. In the present embodiment, the stop spring 46 is situated in the interior of the control pressure chamber 34, between the diaphragm 32 and the casing of the diaphragm box 180. The stop spring 46 presses the diaphragm 32 towards the movement stop 40. Above the rotational speed switching threshold, the suction from the engine intake pipe 12 acts via the electromagnetic 3/2-way valve 48 in the control pressure chamber 34 also, so that the diaphragm 32 is then pulled towards the right against the action of the stop spring 46 until the guide shank 182 strikes against the movement stop 38. The throttle stop 28 thus limits, in the illustrated position, the minimum opening position of the main throttle 14 and, in the displaced position towards the right not illustrated here, limits the maximum closure position of the main throttle 14.

An auxiliary diaphragm 192 is disposed in the continually vented diaphragm chamber 36 and partitions off therefrom a diaphragm intermediate chamber 188, which is connected via a line 190 permanently with the line 66 and, via the latter and the non-return valve 68, with the engine intake pipe 12. Between the diaphragm 32 and the auxiliary diaphragm 192, a compression spring 194 is stressed. A diaphragm rod 196, connected centrally with the auxiliary diaphragm 192 and projecting therefrom in both longitudinal directions, can come to bear with its one end against the throttle stop 28 of the diaphragm 32. At its other end it is conducted outwardly from the diaphragm box 180 through a longitudinally adjustable, sleeve-shaped starting operation setting screw 198. The lever 24, connected with the main throttle 14, is pressed by the spring 26 onto the free end of the diaphragm rod 196, a longitudinally adjustable idling setting screw 202 on the lever 24 bearing against an end auxiliary stop 204 on the free end of the diaphragm rod 196. The starting operation setting screw 198, penetrating into the continually vented diaphragm chamber 36, constitutes at its inner end face a starting operation stop 200, which limits the maximum minimum opening setting of the main throttle 14 in the starting operation.

In the embodiment according to FIG. 7, the illustrated state corresponds to an operation below the rotational speed switching threshold, since the 3/2-way valve 48 ensures venting of the control pressure chamber 34 and the diaphragm 32 bears against the movement stop 40. The suction in the diaphragm intermediate chamber 188 is sufficiently large for the force of the compression spring 194 to be overcome and the diaphragm rod 196 to bear against the throttle stop 28. If the engine rotational speed and thus the vacuum decrease, the compression spring 194 can displace the auxiliary diaphragm 192 towards the left, lifting the diaphragm rod 196 off the throttle stop 28, with the consequence that the minimum opening position of the main throttle 14 and thus the rotational speed are increased. Consequently, the auxiliary diaphragm 192 makes possible a type of regulating function for the idling rotational speed under altitude influence and when additional consumers, such as an air conditioning plant, are switched on.

When the engine is stopped, the illustrated relative positions of diaphragm 32 and auxiliary diaphragm 192 are maintained at least temporarily, since the non-return valve 68 prevents a rapid decrease in the vacuum in the diaphragm intermediate chamber 188. After the engine has stopped, the auxiliary diaphragm 192 can be pressed only gradually by the compression spring 194 against the starting operation stop 200. At starting of the engine, therefore, the main throttle 14 is always opened sufficiently far to be pulled later by the suction which builds up in the diaphragm intermediate chamber 188 by means of the diaphragm rod 196 onto the throttle stop 28. When the rotational speed switching threshold is exceeded, the diaphragm 32 is then moved towards the right by switching-over of the 3/2-way valve 48. The auxiliary diaphragm 192 directly follows this deflecting movement of the diaphragm 32 until the maximum closure limiting state of the main throttle 14 is reached.

Figure 8:
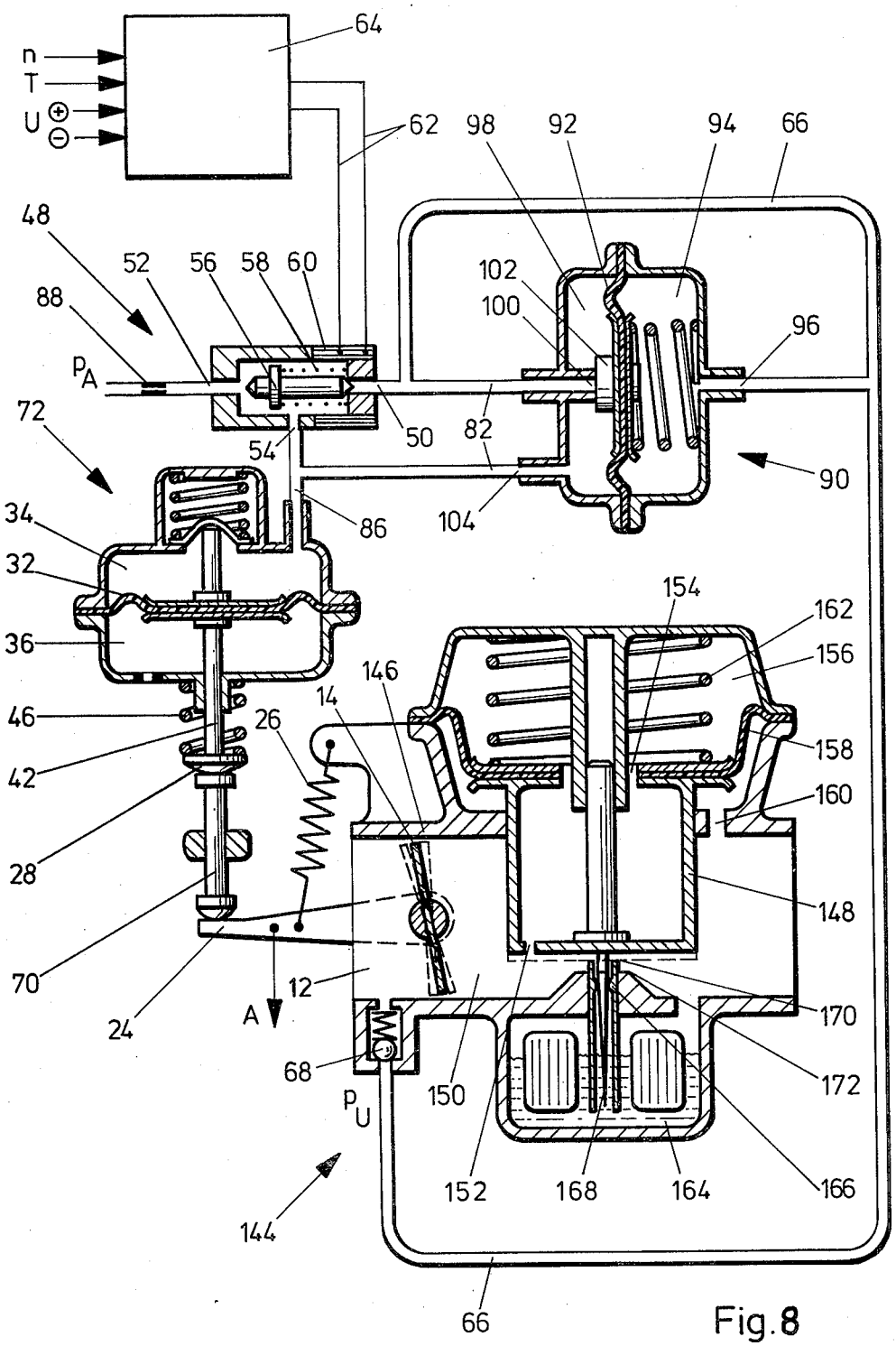
FIG. 8 in a diagrammatic view, an example of use of the third form of embodiment for a constant pressure carburettor.

In FIG. 8 it is illustrated that the device according to the present invention can be used not only in a carburettor with an idling system, such as for example a corresponding fixed air funnel carburettor, but also in a constant pressure carburettor, which normally does not contain any idling system swept by the main throttle 14. The embodiment of FIG. 8 contains, as an example, an application of the third embodiment of FIG. 3, however, it must be pointed out that the other embodiments could equally well be used.

A constant pressure carburettor 144 contains, inside a carburettor wall 146, a mixing chamber 150 which is bounded on the downstream side by a main throttle 14, constructed as pivotal throttle damper. Downstream of the main throttle 14 is situated the engine intake pipe 12. The main throttle 14 is equipped, as in the previous embodiments, with a lever 24 onto which the spring 26 acting in the closure direction acts, which spring pulls the lever 24, when the accelerator pedal is released, via the intermediate element 70 onto the throttle stop 28. In the constant pressure carburettor 144, the pressure in the mixing chamber 150 is maintained constant to a first approximation, independently of the air flow rate, by the position of an air valve 148. The mixing chamber pressure passes, via bore 152 and an annular gap 154, into a diaphragm chamber 156, which is bounded by a diaphragm 158. The diaphragm chamber situated on the other side is loaded via a bore 160 with atmospheric pressure. The force of a compression spring 162 acting upon the diaphragm 158 and the weight of the diaphragm 158 and of the air valve 148 determine the magnitude of the pressure drop of the sucked-in air stream at the air valve 148. This pressure difference acts also as a delivery pressure upon the fuel system, comprising a float chamber 164, a free nozzle cross-section 166 and a profiled nozzle needle 168. The air valve 148 adopts a position dependent upon the air flow rate, so that the nozzle needle 168, connected with the air valve 148, opens a nozzle cross-section 166 dependent upon the air flow rate. As a consequence, the flow rate of the sucked-in fuel also varies as a function of the air flow rate.

To enable the device according to the present invention to be used also in such a constant pressure carburettor, a movement stop 170 for limiting the closure movement of the air valve 148 is so disposed that the air valve 148 just does not come into bearing during idling. When the main throttle 14 is fully closed by the device according to the present invention in the thrust phase or when the engine is shut off, a reduction of the air flow rate takes place down to a slight leakage rate, so that the air valve 148 comes to bear against the movement stop 170. The flow cross-section remaining between the air valve 148 and a bridge 172 has the effect that at this low residual air flow rate the pressure drop at the air valve 148 becomes too small for further fuel to be able to be sucked out of the float chamber 164. Consequently, the fuel supply is cut off when the main throttle 14 is closed. When the main throttle is opened up to the normal idling position, normal pressure conditions once again become established, which leads to a renewed commencement of the fuel delivery.

The engine fuel injection does not normally need to be increased at starting of an already warmed motor during the starting operation. By the use of the movement stop 170 for the air valve 148, however, the air flow rate during the starting operation when the main throttle is situated in the idling position is, in certain circumstances, so small that no supply of the fuel will occur. For this reason, it may be necessary, when starting the engine, to open the main throttle further beyond the position of normal idling running, in order to increase the air flow rate at the air valve 148, so that a fuel supply is assured during the starting operation. This measure is in principle possible with devices for the main throttle adjustment according to FIGS. 2 and 3, whereby in FIG. 8 as an example the use of the embodiment of FIG. 3 is illustrated. Basically, however, the other embodiment could equally well be used.

Within the scope of the present invention, the individual components of the device, such as the 3/2-way valve, the diaphragm box, the differential pressure regulator and the 2/2-way valve, can be varied in respect of their construction. For example, it may be pointed out that the 3/2-way valve could also be replaced by two 2/2-way valves, which can make corresponding connections between the common valve outlet and a pressure source, such as ambient pressure, on the one hand and a suction source, such as the intake pipes suction on the other hand, as a function of operating parameters, such as the rotational speed, engine temperature and ignition voltage. In essence, it would also be possible to use, instead of one or more on-off valves, electromagnetic regulating valves for generating appropriate control pressures and intermediate pressures. It may also be appropriate to make a damper-shaped main throttle of thinner construction in its region which sweeps through an idling system, in order to attain a sharper change in the pressure when the outlet bore 16 of the idling system is swept over.

We claim:

1. Device for the speed-dependent closing limitation of a selectively adjustable carburettor main throttle, a mixing chamber on one side of said main throttle and an engine intake pipe on the opposite side of said main throttle, means for biasing said main throttle in the closing direction, including a variably positionable throttle stop for effecting a substantially complete closure of the main throttle above a rotational speed switching threshold higher than the idling speed, and thus the interruption of the supply of fuel and air and causes an idling minimum opening position of the main throttle below the rotational speed switching threshold, an electromagnetic switching element operated when the speed falls below the rotational speed switching threshold, said electromagnetic switching element comprising an electromagnetic 3/2-way valve (48) having a valve outlet (54), a first valve inlet (50), a second valve inlet (52), and means for selectively closing one of said first and second valve inlet while the other one is open, said first valve inlet in communication with said engine intake pipe, a non-return valve (68) between said first valve inlet and said engine intake pipe said second valve in communication with one of the ambient atmosphere and another pressure source, a diaphragm box (30) divided by a movable diaphragm (32) into a control pressure chamber (34) and a vented diaphragm chamber, said valve outlet is in flow communication with said first valve inlet (50) above the rotational speed switching threshold and also when the ignition is switched off, said valve outlet is in flow communication, with said second valve inlet (52) below the rotational speed switching threshold, said control pressure chamber (34) is in flow communication with the valve outlet (54) and said movable diaphragm (32), a throttle stop (28) mechanically connected to said movable diaphragm, and a stop spring (46) biases said throttle stop (28) toward the idling speed minimum opening position of said main throttle (14).

2. Device according to claim 1, characterized by two fixed movement stops (38,40) for the diaphragm (32) located in said diaphragm box (30,108) on opposite sides of said diaphragm and forming two fixed working points.

3. Device according to claim 2, characterized in that one said working point corresponds the closed position of the main throttle (14) and thus to the interruption of the fuel delivery of the idling system (16) and also to the predominant interruption of the air feed, the other said working point provides an idling minimum opening position of said main throttle (14) and thus adjustable idling mixture delivery.

4. Device according to claim 1, characterized by a first throttle position (84, 100, 102) in a connecting line (82) in parallel with the 3/2-way valve (48) between the first valve inlet (50) and the valve outlet (54), by a second throttle position (88) at the second valve inlet (52), by a fixed movement stop (38) for the diaphragm (32), permitting a complete closure of the main throttle (14), and by a diaphragm intermediate position which occurs in normal idling and corresponds to the idling minimum opening position of the main throttle (14), from which (diaphragm intermediate position), when the intermediate pressure in the control pressure chamber (34) generated by the throttling positions (84, 88, 100, 102) rises, the diaphragm (32) deflects in an additional working range in the direction of opening of the main throttle (14) so as to regulate the speed, and from which (diaphragm intermediate position), when valve switching over connects the valve outlet (54) with the first valve inlet (50), the diaphragm (32) comes up against the fixed movement stop (38).

5. Device according to claim 4, characterized by an intermediate stop (76), spring-prestressed in the direction of opening of the main throttle and movable between the fixed movement stop (38) and a further fixed stop (80), against which (intermediate stop 76) the diaphragm (32) or a projection (74) connected therewith bears during normal idling.

6. Device according to claim 4 or 5, characterized by constant throttle cross-sections of both the throttle positions (84, 88).

7. Device according to claim 4 or 5, characterized by a pressure-regulating, variable cross-section of the first throttle position (100, 102) and by a constant throttle cross-section of the second throttle position (88).

8. Device according to claim 7, characterized by a differential pressure regulator (90), constituting the first throttling position (100, 102), and comprising a diaphragm (92), a spring (106) prestressing the diaphragm (92) in a control pressure chamber (94) connected with the engine intake pipe (12) via a non-return valve (68) at one side of the diaphragm, a diaphragm chamber (98) at the other side of the diaphragm, a first opening (100) at the diaphragm chamber (98) cooperating in flow-throttling manner with the diaphragm (92) or a projection (102) connected therewith and likewise connected with the engine intake pipe (12) via a non-return valve (68), and comprising a second opening (104) at the diaphragm chamber (98) connected with the valve outlet (54).

9. Device according to one of claims 1 to 3, characterized by an auxiliary diaphragm (110) disposed in the control pressure chamber (34) and partitioning off therefrom a diaphragm intermediate chamber (116), by a throttled flow connection (122) between the control pressure chamber (34) and the diaphragm intermediate chamber (116), by a directly acting auxiliary stop (114), mechanically connected with the auxiliary diaphragm (110), arranged in front of the indirectly operating throttle stop (28) and movable relative to the latter, which (auxiliary stop 114) is prestressed by means of the spring (26) prestressing the main throttle (14) in the closure direction to bear against the throttle stop (28), and by movement stops (118, 120), associated with each other, at the diaphragms (32, 110), having a movement clearance between the movement stops (118, 120) when the auxiliary stop (114) bears against the throttle stop (28).

10. Device according to claim 9, characterized by a connecting rod (42), connected with the diaphragm (32), conducted outwardly, and constituted as guide sleeve, having an end-located, annular throttle stop (28), and (characterized) by a rod (112) connected with the auxiliary diaphragm (110) and passing through the guide sleeve to the auxiliary stop (114).

11. Device according to claim 10, characterized by an electromagnetic 2/2-way valve (130) in a line (128,66) connecting the diaphragm intermediate chamber (116) with the engine intake pipe (12), and by a control (64) for opening the 2/2-way valve (130) when the speed falls sufficiently below the idling rotational speed or when a switch contact is actuated upon insertion of the gear stage or switching-on of the air conditioning plant.

12. Device according to claim 11, characterized by a control (64), possessing a rotational speed hysteresis, for the 2/2-way valve (130) having a switching-on point below the idling set-point rotational speed and a switching-off point above it.

13. Device according to one of claims 1 to 3, characterized by a diaphragm (32), movable between two movement stops (38, 40), by an auxiliary diaphragm (192) disposed in the vented diaphragm chamber (36) and partitioning off therefrom a diaphragm intermediate chamber (188) connected with the engine intake pipe (12) via a non-return valve (68), (the auxiliary diaphragm 192) having a diaphragm rod (196) fixed thereto and projecting on both sides, the ends of which can come into bearing engagement on the one hand with the indirectly operating throttle stop (28) at the diaphragm (32) and on the other hand, as auxiliary stop (204), with a portion (202) of the main throttle (14), by a compression spring (194) clamped between the diaphragm (32) and the auxiliary diaphragm (192), and by a starting operation stop (200), up to which the auxiliary diaphragm (192) can be moved forwards up to the engine start and, thereafter, as the rotational speed falls can be moved forwards by means of the compression spring (194) in the sense of an additional increase to the main throttle minimum opening.

14. Device according to claim 13, characterized by a compression spring clamped in the control pressure chamber (34) of the diaphragm box (180) between the diaphragm (32) and the wall of the diaphragm box (180), as stop spring (46) which prestresses the throttle stop (28) to the idling minimum opening position of the main throttle (14).

15. Device according to claim 13 characterized by an adjustable movement stop (38), associated with the diaphragm (32), for the maximum closure state of the main throttle (14) and/or (by) an adjustable starting operation stop (200) and/or by and adjustable idling adjustment means (202).

16. Device according to claim 15, characterized by a longitudinally adjustable, hat-shaped thrust setting screw, serving as movement stop (38) for the main throttle closure state and into the guide opening of which a guide shank (182) of the diaphragm (32) engages longitudinally displaceably.

17. Device according to claim 15, characterized by a longitudinally adjustable, sleeve-shaped starting operation setting screw, (198), constituting at its end the starting operation stop (200), through which (screw) a portion of the diaphragm rod (196) is guided longitudinally displaceable out of the diaphragm box (180).

18. Device according to claim 15, characterized by a longitudinally adjustable idling setting screw (202), pressed onto the auxiliary stop (204) of the diaphragm rod (196) by means of the main throttle prestress acting in the closure direction (this setting screw 202 being) on a lever (24) connected to the main throttle (14).

19. Device according to one of claims 1 to 5, characterized by an electronic control (64) for energizing the 3/2-way valve (48) when an ignition voltage (U) is applied and at a rotational speed (n) below the rotational speed switching threshold.

20. Device according to claim 19, characterized by an electronic control (64) having an engine-temperature-dependent, opposed variation of the rotational speed switching threshold.

21. Device according to claim 19, characterized by a common electronic control (64) for the 3/2-way valve (48) and the 2/2-way valve (130).

22. Device according to one of claims 1 to 5, characterized by a movement stop (170) for the air valve (148) adjacent approximately to the idling position of the air valve (148) of a constant pressure carburettor (144), for an interruption of the vacuum pressure-dependent fuel delivery in the case of a closure of the main throttle (14) which goes beyond the idling position.

* * * * *